US006957610B2

(12) United States Patent
Cummins

(10) Patent No.: US 6,957,610 B2
(45) Date of Patent: Oct. 25, 2005

(54) JOINT SEAL FOR A FLEXIBLE TRAIN

(76) Inventor: Richard D. Cummins, 33 Harmony Cir., Orchard, NY (US) 14127

( * ) Notice: Subject to any disclaimer, the term of this patent is extended or adjusted under 35 U.S.C. 154(b) by 344 days.

(21) Appl. No.: 10/405,912

(22) Filed: Apr. 2, 2003

(65) Prior Publication Data

US 2004/0195829 A1 Oct. 7, 2004

(51) Int. Cl.[7] ..... B60D 5/00
(52) U.S. Cl. ..... 105/8.1; 105/15
(58) Field of Search ..... 105/8.1, 15, 16, 105/18, 19, 20, 402, 365

(56) References Cited

U.S. PATENT DOCUMENTS 5,433,155 A * 7/1995 O'Neill et al. ..... 104/282
5,460,098 A * 10/1995 Jackson et al. ..... 104/23.2
5,950,543 A * 9/1999 Oster ..... 104/138.1

* cited by examiner

*Primary Examiner*—S. Joseph Morano
*Assistant Examiner*—Robert J. McCarry, Jr.
(74) *Attorney, Agent, or Firm*—Sofer & Haroun, LLP

(57) ABSTRACT

The present invention provides for a flexible connection for connecting train cabins in a train. The connection comprises a first tubular train cabin having an end portion having a first diameter and a second tubular train cabin having a front portion having a second diameter. The second diameter is greater than the first diameter such that the end portion of the first train cabin fits within the front portion of the second train cabin.

At least one flexible buffer ring, extending around an outer circumference of the end portion of the first train cabin is positioned as a cushion between the outer circumference of the end portion of the first train cabin and the inner circumference of the front portion of the second train cabin such that when the train enters a curve and the first train cabin turns relative to the second train cabin about a pivot axis. The flexible buffer ring provides a stable cushioned connection between the train cabins.

16 Claims, 3 Drawing Sheets

JOINT SEAL FOR A FLEXIBLE TRAIN

FIELD OF THE INVENTION

The present invention relates to a joint for connection of train cabins. More specifically, the present invention relates to a flexible joint for connection of high speed train cabins.

BACKGROUND

Advances in high speed trains have allowed manufactures to create trains capable of speeds well in excess of 100 mile per hour. In order to accomplish this, not only have the power sources been increased in performance but other advances have been made in order to accommodate the increased speeds. Simple addition of more powerful engines is insufficient in and of itself to greatly increase the overall train speed because the older parts still used in the cabins and trucks of the trains limit the overall speed.

Several advances have been made to accommodate the increased power sources so that the cabins will present less limiting factors to the overall train speed. For example, the most common advances include tilting mechanisms which allow trains to tilt into turns so that higher speeds can be maintained on curved track. Other advances include different forms of track and truck connections such as magnetic and air levitation which greatly reduce the accompanying noise as well as preventing speed loss due to friction.

However, there are still many mechanical connection points in trains which still pose limiting factors which prevent the power sources from fully increasing the overall train speed to full potential. One such mechanical interconnection occurs at the meeting place between train cabins which are usually connected with a coupling device. The coupling devices currently in use have metal joints which allow some axial motion between each other causing imperfect connections which present limiting factors for the overall train speed. The currently used connectors are not capable of maintaining good connection at higher speeds. Also, the current coupling devices add to the noise associated with the train cabin connectivity, particularly at high speeds.

Therefore, a need exists in the industry of high speed trains to provide a joint for connection train cabins which is compatible with high speed connectivity and does not suffer from the traditional drawbacks of mechanical couplers. The present invention provides such a joint.

SUMMARY OF INVENTION

As such, the present invention looks to overcome the drawbacks associated with the prior art and provides for a flexible connection for connecting train cabins in a train. The connection is comprised of a first tubular train cabin having an end portion with a first diameter. A second tubular train cabin is provided having a front portion having a second diameter, where the second diameter is greater than the first diameter. This allows the end portion of the first train cabin to fit within the front portion of the second train cabin.

At least one flexible buffer ring is provided which extends around an outer circumference of the end portion of the first train cabin, positioned as a cushion between the outer circumference of the end portion of the first train cabin and the inner circumference of the front portion of the second train cabin. In this configuration, when the train enters a curve and the first train cabin turns relative to the second train cabin about a pivot axis the flexible buffer ring provides a stable cushioned connection between the train cabins.

DETAILED DESCRIPTION

Figure 1:
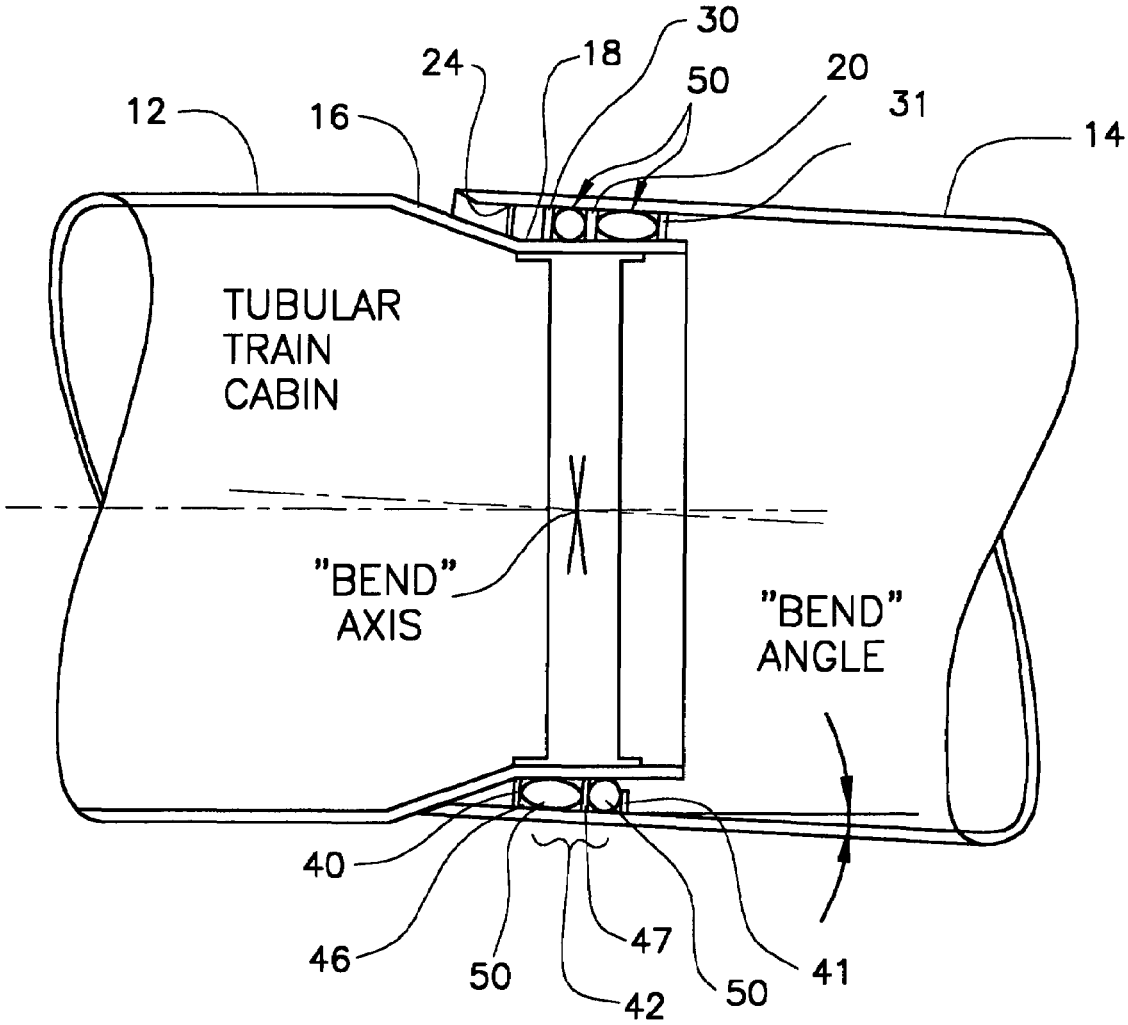
FIG. 1 illustrates a top view of a flexible connection, in accordance with one embodiment of the present invention.

In one embodiment of the present invention as illustrated in FIG. 1, the present invention is directed to a flexible connection 10 for use in connecting train cabins in high speed train. Although connection 10 is designed to supply a better means of connecting train cabins compatible with high speeds this is in no way intended to limit the scope of the present invention. For example, the same connection means can be used on standard or older model trains if the situation were to present itself. However, for the purposes of illustration, connection 10 will refer to a connection between the cabins of high speed, trains designed to travel in excess of 100 miles per hour.

In one embodiment of the present invention, as illustrated in FIG. 1, a first train cabin 12, and a second train cabin 14 are linked at flexible connection 10. For the purposes of illustration both cabins 12 and 14 are substantially tubular in shape, however, other shapes can be used. Cabins 12 and 14 are preferably constructed of aluminum materials similar to a monocoque aircraft skin design, however any design using lightweight, durable metal can be used provided it meets the necessary specifications for high speed train cabins.

As illustrated in FIG. 1, first train cabin 12 has a tapered end portion 16 having an outer circumference 18. Tapered end portion 16 fits within a front portion 20 of second train cabin 14 in order to connect cabins 12 and 14.

Figure 2:
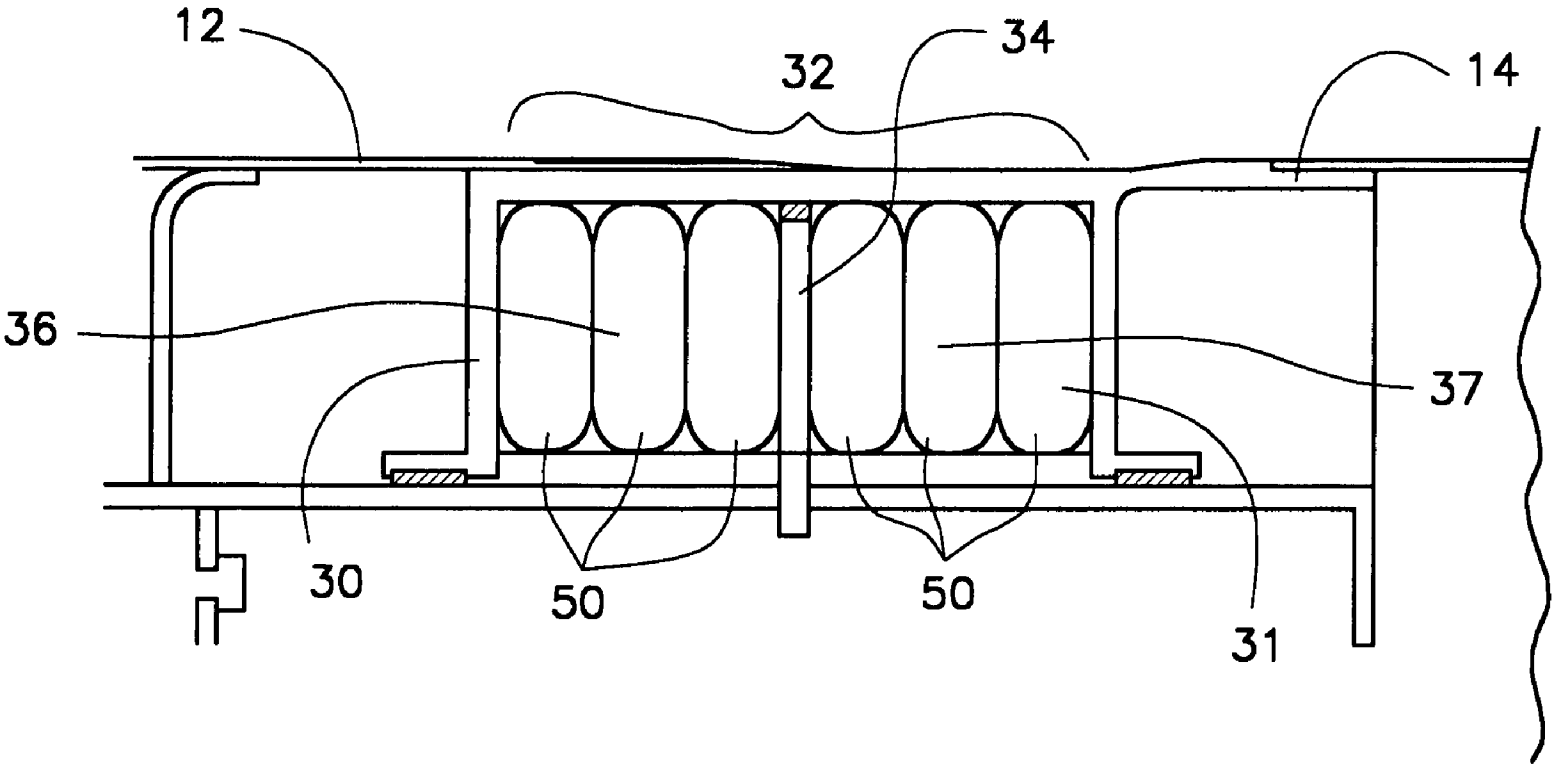
FIG. 2 illustrates a close up top view of buffer rings, in accordance with one embodiment of the present invention.

In another embodiment of the present invention as illustrated in FIGS. 1, and 2 tapered end portion 16 of first train cabin 12 maintains first and second outer ring flanges 30 and 31 disposed about outer circumference 18 of first train cabin 12 and extends to inner perimeter 24 of front portion 20 of second train cabin 14. First and second outer flanges 30 and 31 which extend across the gap between first and second train cabins 14, form a closed volume 32.

Additionally, a separator ring 34 may be located on outer circumference 18 of first train cabin 12, disposed such that it bisects outer flanges 30 and 31 so as to further subdivide closed volume 32 into first and second chambers 36 and 37.

In an alternative embodiment of the present invention, as illustrated in FIG. 1, front portion 20 of second train cabin 14 maintains first and second inner ring flanges 40 and 41 disposed about inner circumference 24 of second train cabin 14 and extends to outer perimeter 18 of tapered end portion 16 of first train cabin 12. First and second inner flanges 40 and 41, which extend across the gap between first and second train cabins 14, form a closed volume 42.

Additionally, a separator ring 44 may be located on inner circumference 24 of second cabin 14, disposed such that it bisects inner flanges 40 and 41 of second train cabin 14 such that closed volume 42 is further subdivided into first and second chambers 46 and 47.

It should be noted that for the purposes of illustration, ring flange assemblies discussed below refer to flanges 30, 31 and separator ring 34 disposed on first train cabin 12, however, this is in no way intended to limit the scope of the present invention. For example, the entire flange assembly, such as those discussed above as flanges 40, 41 and separator ring 44, can be entirely located on second train cabin 14. Either configuration is acceptable provided that the entire flange assembly is disposed on one of the two connected train cabins. Their operation in connection with train cabins 12 and 14 are discussed below in detai.

In another embodiment of the present invention, as illustrated in FIGS. 1 and 2, a flexible buffer ring 50 is disposed about outer circumference 18 of tapered end portion 16 of first train cabin 12 and configured to provided a cushion to fill the gap between tapered inner portion 16 of first train cabin 12 and front portion 20 of second train cabin 14. Additionally, consecutively placed buffer rings 50 can be used in order to provide additional stability to the connection.

Buffer rings 50 are preferably constructed in a flexible rolling diaphragm design of woven or rubberized fabric, however this is in no way intended to limit the scope of the present invention. The use of any substance, capable of being pressurized in some capacity, which provides an adequate cushion between first and second train cabins 12 and 14, is within the contemplation of the present invention.

Buffer rings 50, are preferably filled with air or water based liquids which provide adequate resistance to the opposing walls of front portion 20 of second train cabin 14 and tapered end portion 16 of first train cabin 12 such that when the train enters a curve at high speeds, buffer rings 50 will be sufficiently rigid so as to prevent first and second train cabins from contacting one another yet sufficiently elastic so as to allow cabins 12 and 14 to turn with respect to one another about the bend axis.

Buffer rings 50 may be filled, with either air or liquid, to a pressure sufficient to cushion cabins 12 and 14. Buffer rings 50, based on their size and the surface area in contact with cabins 12 and 14 are preferably filled to a low pressure in the range of 5–25 psi, however, this is in no way intended to limit the scope of the present invention. Any pressure capable of providing the necessary level of rigidity/elasticity, taking into account such variables as temperature, train speed and train weight, is within the contemplation of the present invention.

In another embodiment of the present invention, as more clearly illustrated in FIG. 2, buffer rings 50 are disposed around outer circumference 18 of tapered end 16 of first train cabin 12 such that rings 50 are disposed in closed volume 32. For the purposes of illustration closed volume 32 formed by first and second outer flanges 30 and 31 will be used throughout.

Buffer rings 50 are disposed within closed volume 32 so as to keep rings 50 within a limited confines so that rings 50 do not slip off of the end of tapered end portion 16 of first cabin 12 so as to maintain a stable cushion between train cabins 12 and 14.

In another embodiment of the present invention, as illustrated in FIG. 2, buffer rings 50 are disposed within closed volume 32 in first and second chambers 36 and 37, such that rings 50, which provide the bumper between inner circumference 24 of second train cabin 14 and outer circumference 18 of first train cabin 12 for movements transverse to the axis of train movement, will also be in contact with first and second train cabins 12 and 14 via separator ring 34 in the axis of train movement. In this configuration, not only will rings 50 provide a cushion between cabins for angled turn movements outside of the train movement axis between the cabins (along the bend axis), but also will provide addition cushioning when the train stops and starts, where first and second train cabins 12 and 14 move closer and further apart within the train movement axis.

Any number of rings 50 may be employed in first and second chambers 36 and 37 of closed volume 32 such that failure of a single ring 50 will not entirely destroy the overall connectivity benefits between first and second train cabins 12 and 14.

Figure 3:
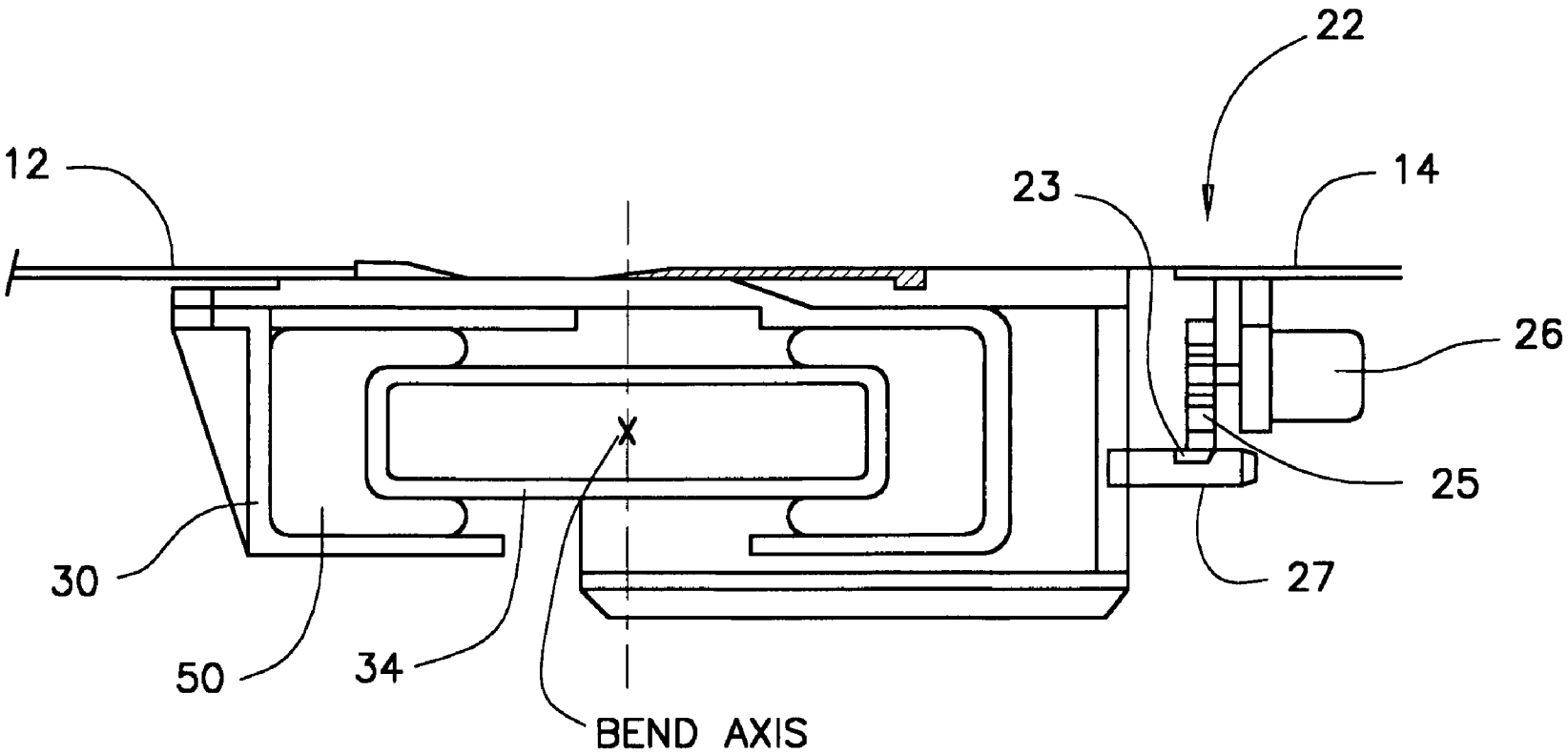
FIG. 3 illustrates a close up top view of a separator, in accordance with one embodiment of the present invention.

In another embodiment of the present invention as illustrated in FIG. 3, a retractable separator mechanism 22 is disposed in either one of first train cabin 12 or second train cabin 14, configured to securely attach the opposite train cabin. For the purposes of illustration, cabin separator mechanism 22 is located in second train cabin 14, however this is in no way intended to limit the scope of the invention.

Retractable separator mechanism 22 is located within front portion 20 of second train cabin 14. Retractable separator mechanism 22 is comprised of a gear motor 26 and a gear locking ring 25 having cam surfaces located thereon. A series of locking pins 27 are disposed on the end of a connector ring 39. Locking pins 27 maintain gear notches 23 for accepting the cam surfaces of locking ring 25. Additionally, a separator ring 34, rigidly coupled to connector ring 39, is disposed between buffer rings 50 further adds stability to the connectivity between train cabins 12 and 14 as discussed above. Separator ring 34is preferably rectangular in shape, designed to press against separator ring 50 in closed volume 32.

As illustrated in FIG. 3, connector ring 39 extends from locking pins 27, past second outer flange 31 and upwardly towards the center of connection 10 to separator ring 34. It should be noted that FIG. 3 is a cutaway view of connection 10 and as such, only one locking pin 27 connection is illustrated. However, as both cabins 12 and 14 are cylindrical in shape it is within the contemplation of the present invention that the series of locking pins 27 are disposed around the circumference of cabins 12 and 14 so as to provide a more stable connection between the two.

When connecting first train cabin 12 to second train cabin 14, the entire assembly of first and second outer flanges 30 and 31 are attached to tapered end portion 16 of first train cabin 12. As illustrated in FIG. 3, separator ring 34, coupled to connector ting 39 is disposed such that the separator ring 34 is placed in closed volume 32, between at least on buffer ring 50 on the side of first outer flange 30 and a buffer ring 50 on the side of second outer flange 31.

After separator ring 34 is in place, locking pins 27, coupled to separator ring 34 via connecting ring 39 are moved into proximity with retractable separator mechanism 22 located on second train cabin 14. After train cabins 12 and 14 are in place and locking pins 27 are inserted into retractable separator 22, gear motor 26 rotates gear locking ring 25 such that its cam surface engages gear notches 23 of locking pins 27, thereby securing together first and second train cabins 12 and 14. Thus, in the attached position, connection and axial and compression movement between first and second cabins 12 and 14 is supported through the interaction between separator ring 34 and buffer rings 50 in closed volume 32. In order to uncouple the cabins gear motor 26 simply rotates gear locking ring 25 so as to disengage its cam surface from gear notches 23 of locking pins 27.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. A flexible connection for connecting train cabins in a train, said connection comprising:

a first tubular train cabin having an end portion having a first diameter;

a second tubular train cabin having a front portion having a second diameter, wherein said second diameter is greater than said first diameter such that said end portion of said first train cabin fits within said front portion of said second train cabin; and at least one flexible buffer ring extending around an outer circumference of said end portion of said first train cabin, positioned as a cushion between said outer circumference of said end portion of said first train cabin and said inner circumference of said front portion of said second train cabin such that when said train enters a curve and said first train cabin turns relative to said second train cabin about a pivot axis, said flexible buffer ring provides a stable cushioned connection between said train cabins.

2. The flexible connection as claimed in claim 1, further comprising a plurality of flexible buffer ring disposed about said outer circumference of said end portion of said first train cabin.

3. The flexible connection as claimed in claim 2, further comprising first and second outer flange rings disposed about the outer circumference of said end portion of said first train cabin extending to said inner circumference of said front portion of said second train cabin thereby forming a closed volume between said first and second train cabins.

4. The flexible connection as claimed in claim 3, further comprising a separator ring disposed between said first and second outer flange rings so as to subdivide said closed volume into first and second chambers.

5. The flexible connection as claimed in claim 4, wherein said at least one of said plurality of said buffer rings are disposed in each one of said first and second chambers of said closed volume.

6. The flexible connection as claimed in claim 4, further comprising a connection ring, coupled to said separator ring configured to extend from said separator ring, out of said closed volume.

7. The flexible connection as claimed in claim 6, wherein said connector ring maintains at least one locking pin, said locking pin maintaining a gear notch.

8. The flexible connection as claimed in claim 7, wherein said front end of said second train cabin further comprises a separator mechanism, said separator mechanism configures to connect said first train cabin to said second train cabin.

9. The flexible connection as claimed in claim 8, wherein said separator mechanism further comprises a gear motor configured to rotate a gear locking ring between a first connected position, where said gear locking ring is in connection with said at least one locking pin, and a second unconnected position where said gear locking ring is unconnected to all of said locking pins.

10. The flexible connection as claimed in claim 9, wherein said gear locking ring maintains a cam surface configured to engage said gear notch on said locking pin to provide a more stable connection between said locking pin and said gear locking ring.

11. The flexible connection as claimed in claim 1, wherein said flexible buffer ring is constructed of a rubberized fabric.

12. The flexible connection as claimed in claim 1, wherein said flexible buffer ring is constructed of a woven fabric.

13. The flexible connection as claimed in claim 1, wherein said buffer ring is filled with air.

14. The flexible connection as claimed in claim 1, wherein said buffer ring is filled with a water based fluid.

15. The flexible connection as claimed in claim 1, wherein said buffer ring is pressurized at a low pressure.

16. The flexible connection as claimed in claim 1, wherein said buffer ring is pressurized between 5 and 25 psi (pounds per square inch).

* * * * *